United States Patent [19]

Fournier et al.

[11] 4,136,448

[45] Jan. 30, 1979

[54] CAN OPENER

[76] Inventors: Erick-Pierre Fournier; Ethel V. Hill, both of 30 Park Ave., New York, N.Y. 10016

[21] Appl. No.: 707,707

[22] Filed: Jul. 22, 1976

[51] Int. Cl.[2] ..... B67B 7/24

[52] U.S. Cl. ..... 30/450; 30/407

[58] Field of Search ..... 30/407, 414, 446, 449, 30/450; 16/150; 72/294, 325, 464

[56] References Cited

U.S. PATENT DOCUMENTS

| | | | |
|---|---|---|---|
| 2,046,879 | 7/1936 | Leppke | 30/450 |
| 2,285,783 | 6/1942 | Reenstierna | 30/407 |
| 2,321,485 | 6/1943 | Harvey | 30/407 X |
| 2,648,900 | 8/1953 | Anderson | 30/450 |
| 2,825,966 | 3/1958 | Beecher | 30/450 |
| 3,676,896 | 7/1972 | Maleck | 16/150 |

*Primary Examiner*—Gary L. Smith

*Attorney, Agent, or Firm*—Morgan, Finnegan, Pine, Foley & Lee

[57] ABSTRACT

A sealable edged aperture is produced in a can top by a generally triangular shaped cutting element which severs a flap-like portion from the can top. The cutting element also includes a wedging structure for folding a portion of the severed flap into abutting relationship with the underside of the can top to provide a discrete seal edge on the aperture. The cutting element is carried on a lever arm which is pivotally attached to a manually grippable element positioned adjacent the can sidewall. A bridging element is also provided at the pivot point to support the opener in the can.

9 Claims, 23 Drawing Figures

CAN OPENER

BACKGROUND OF THE INVENTION

The present invention relates to the field of can openers. Most household metal containers for liquid foods or chemicals require that their top be perforated by means of some type of can opener, except for those containers fitted with some built-in opening mechanism, such as a pull-tab, screw cap or friction lid.

The most commonly used implement for puncturing can tops consists of a triangular shaped cutting edge (frequently referred to as a "church key") that is levered into the metal top from the rim of the can to create one or two apertures through which the contents can be directly poured.

Convenient as it is, this mode of operation presents a dual shortcoming: on the one hand, pouring straight from the container creates a spilling hazard, and the larger the can, the greater the risk. This risk is particularly present for viscous liquids, such as cooking oils or liquid chocolate concentrate. On the other hand, because the can openings produced by conventional can openers are small and the triangular cut-out portion of the can top is folded straight down into the can, there is little possibility of developing or even adapting any appropriate sealing device to keep the can contents from evaporating or from losing their flavor. This drawback is particularly applicable to large size cans of fruit juices, evaporated milk or liquid diet foods.

Various types of sealing devices combining a spout and lid structure have been designed to fit pull-tab can openings, as described in our co-pending U.S. patent applications, Ser. Nos. 620,124 and 620,180, both filed Oct. 6, 1975. While these sealing devices can be conveniently adapted to cylindrical or oblong flat top cans to overcome the aforedescribed shortcomings, they do require a specially designed can opener capable of developing a suitably sealable opening.

Accordingly, it is the prime objective of this invention to provide an opener designed to cut in a can top a suitable perforation of generally triangular but standard shape, which can be plugged air-tight by means of a variety of specially fitting capping devices of correspondingly standard geometry.

It is another objective of this invention to provide a can opener designed to make a can opening of such characteristics that substantially flexible thermoplastic capping spouts can develop therewith a suitably tight seal and be made to pour from as well.

It is still another objective of this invention to provide a can opener of simple and safe mechanism capable of being used by people of most ages as ordinary means of creating a convenient aperture for the pouring of contents from the can.

SUMMARY OF THE INVENTION

The present invention is directed to a can opener designed to produce a sealable aperture to accept sealing devices of the type described in our above-identified applications.

The opener includes a lever arm which is pivotally connected to a gripping element. The gripping element includes a bridge portion which is positioned on the rim of the container, and the gripping element is positioned adjacent the can wall. In this manner the can and gripping portion are held in one hand and the lever arm is operated by the other hand.

The aperture is produced by a cutting element carried on the lever arm. As the lever arm is pivoted downwardly into contact with the can top, the cutting element severs a generally triangular shaped flap portion therefrom. This flap is folded into the can and a wedging element in or on the cutting blade folds the base of the flap into abutment with the underside of the can top.

DETAILED DESCRIPTION

Figure 1:
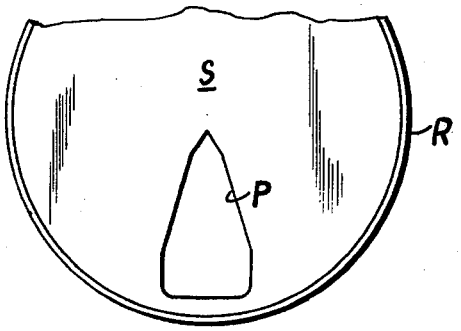
FIG. 1 is a fragmentary, top plan view of a container having a generally triangular shaped aperture produced by the can opener of the present invention.

While this invention is susceptible of embodiment in many different forms, there is shown in the drawings and will hereinafter be described in detail a preferred embodiment of the invention, and modifications thereto, with the understanding that the present disclosure is to be considered as an exemplification of the principles of the invention and is not intended to limit the invention to the embodiments illustrated.

THE OPENER STRUCTURE

Figure 13:
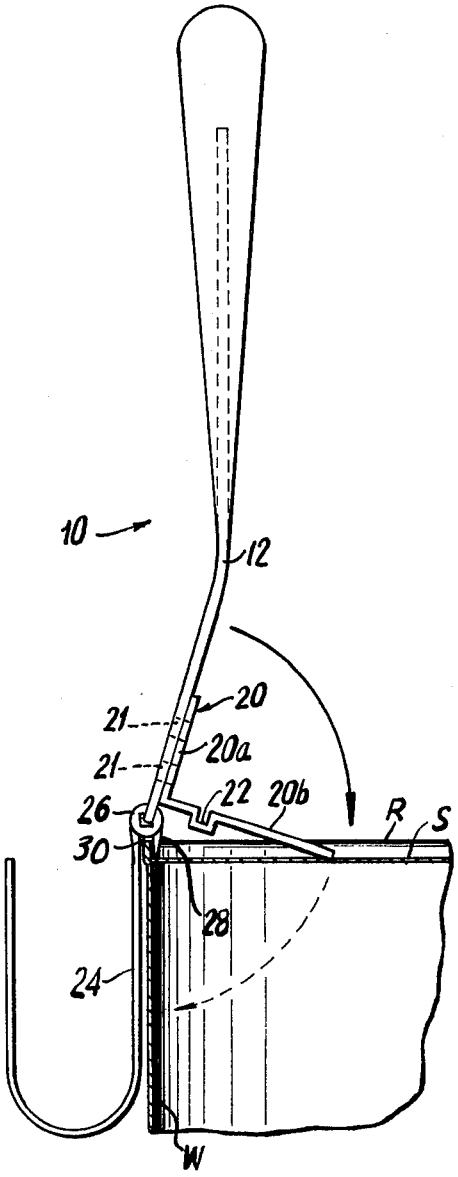
FIG. 13 is a side view of a can opener of this invention shown in the pre-opening position on a container.
Figure 16:
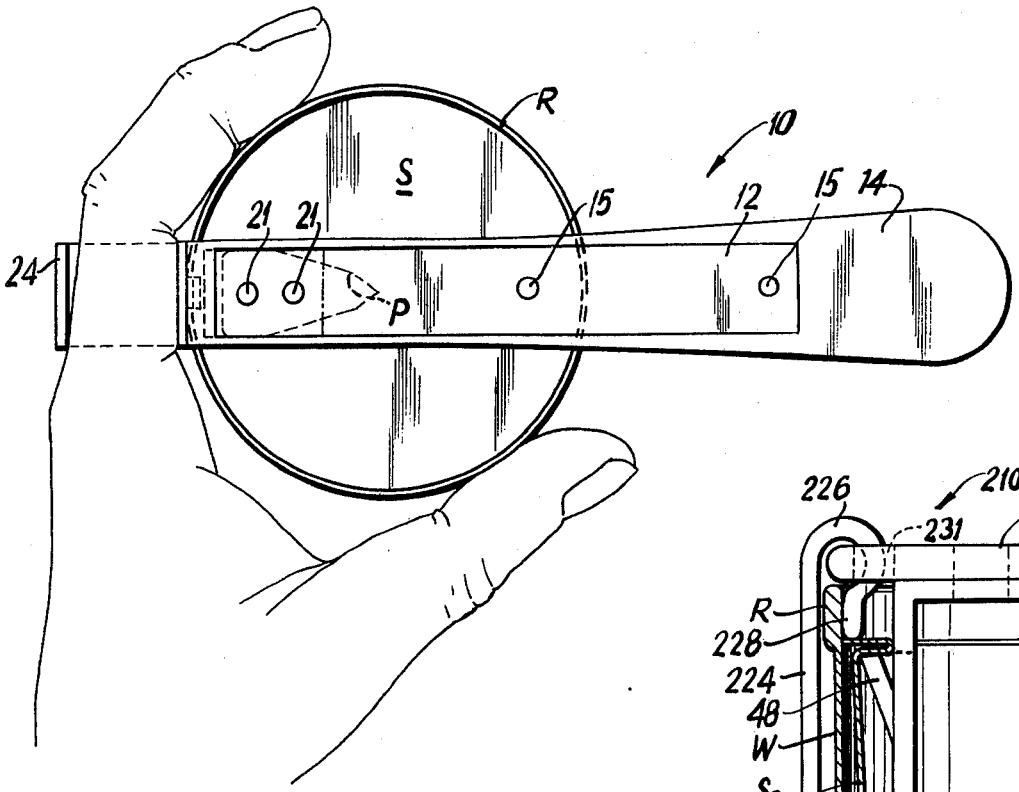
FIG. 16 is a top plan view of the opener of FIG. 13 in the post-opening position.

FIGS. 13 and 16 illustrate an opener 10 of this invention. Can opener 10 includes three basic components:

First, a metal support structure or lever arm 12 terminated at its free end by a plastic handle portion 14. Lever arm 12 may be embedded in or attached to handle 14, as by rivets 15. The length of arm 12 is such that it extends substantially beyond the opposite edge of the can, when positioned thereon, to provide both sufficient leverage and clearance space for the hand during the opening operation.

Second, an L-shaped cutting element 20, made of such material as high carbon steel. One leg **20*a* of element 20 is suitably attached, as by rivets 21, to the underside of lever arm 10. The other leg 20*b* depends from lever arm 10 to provide a generally triangular shaped, perforating blade and having in its upper portion a protruding wedge 22 extending forward by at least about three millimeters beyond the surface of the blade 20b. As it will be described later in greater detail, the wedge 22** is designed to fold the triangular cut-out portion $S_2$ of the can top underneath the lid S and to create thereby a suitably flat peripheral surface with which the sealing lips of a capping device can engage to develop an appropriate seal.

Third, starting from the rim R and extending parallel with the side wall W of the can, is a hand grip, preferably incorporated in a U-shaped knuckles support 24 designed to be grasped and held down with the can. The upper end of the hand grip includes a hinge 26 pivotally connected to lever arm 12. Hinge 26 provides the handle 12 with a fulcrum point about which it can be manually pivoted along an 180° arc and thus made to perforate the can top by means of cutting element 20.

Hinge 26 also includes an integral, depending anchoring bridge 28 forming an inverted U-shaped cavity 30 with hinge 26 and support 24, designed to fit over the rim R of the can. Bridge 28 extends about three millimeters down to the top of the lid S.

In cooperation with the downward force exerted by the left hand on the side grip 24, the anchoring bridge 28 permits the transmission of the necessary counterforce against the can and the development of adequate stability required to press down the lever arm 12 with the right hand for perforating the can lid as depicted in FIG. 16.

The resulting aperture P shown in FIG. 1 is an opening of generally triangular geometry with a straight base and of sufficient length from tip to tip to allow the insertion of either a sealing plug or a spout-lid capping device through which pouring can be conveniently effected.

ALTERNATIVE EMBODIMENTS

Having described the basic structure of a can opener of this invention, we will describe the various alternative structures which may be incorporated into the opener.

A. BLADE ALTERNATIVES

Figure 2:
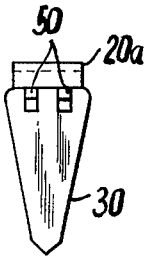
FIGS. 2–6 are top views illustrating various configurations of the cutting blades of a can opener of the present invention.
Figure 3:
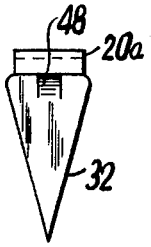
Figure 4:
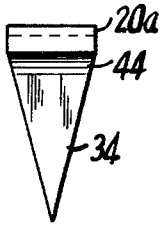
Figure 5:
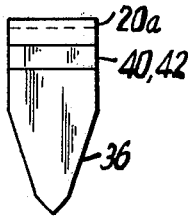
Figure 6:
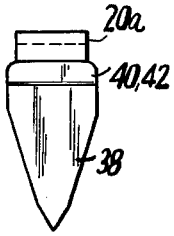

The design of the cutting element blade can assume two basic types of variances:

First, the generally triangular geometry of the cutting blade 20b can vary in its configuration as shown by blades 30, 32, 34, 36, and 38 in FIGS. 2 through 6. Depending upon the configuration of the desired can opening P, and the hardness of the steel used, the angulation of the leading edge of the blade can be made obtuse, FIGS. 3 and 4, or flaired, FIGS. 2 and 5, while the lateral contour of the blade can be made either truncated, FIGS. 5 and 6, oblique, FIGS. 3 and 4, or in any one of those profiles combined with curved trailing edges, as shown in FIGS. 2, 3 and 6.

Second, the folding wedge 22 of the cutting blade 20b can also assume a variety of designs as shown in FIGS. 7 through 12.

Figure 7:
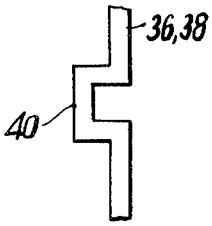
FIGS. 7–12 are side views illustrating various configurations of wedging elements incorporated in the cutting blades of a can opener.
Figure 10:
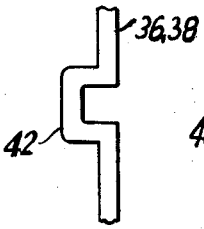

In FIGS. 7 and 10, the steel wedges 40 and 42 are stamped in the form of a square "gooseneck" across the entire width of the blade 36 or 38, FIGS. 5 and 6. Alternately, the "gooseneck" wedge 44 can assume a triangular profile shown in FIGS. 4 and 9.

Figure 8:
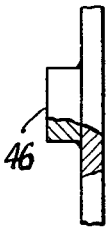
Figure 9:
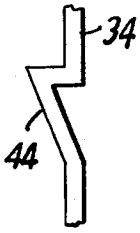
Figure 11:
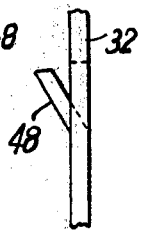
Figure 12:
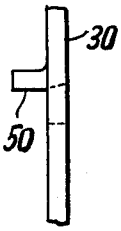

Another type of wedge 46 is shown in FIG. 8 and consists of one or two blocks of steel welded in abutment to the flat surface of the cutting blade. Finally, a third possibility involves, depending upon the structural strength of the metal used, one or more "lanced" protrusion wedges 48 or 50 as shown in FIGS. 3 and 11; 2 and 12.

As long as the depth of the protruding wedge is at least three millimeters, any of the above-described designs 40, 42, 44, 46, 48 and 50 can achieve the desired objective and the optimum shape becomes largely a matter of manufacturing cost and desired life cycle of the cutting blade.

Irrespective of its particular design, the folding wedge 22 of the cutting blade is one of the most important elements of the present can opener. As stated earlier, a major limiting factor of the current types of can openers in use is the fact that the triangular cut-out portion of the can top is folded straight down into the can. Therefore, the cut-out tongue presents a smooth, vertical surface against which there is no possibility of developing any kind of leak-proof or air-tight seal.

With the present can opener 10, in contrast, the wedge 22 is situated along the upper level of the cutting blade in such a way that, after the cut-out section $S_2$ of the can top S has been perforated and pushed down by the cutting blade 20b in parallel position with the wall of the can, its upper section is suitably tucked right underneath the lid surface of the can as the cutting blade terminates its course. See FIGS. 14, 15, 17 and 19.

Figure 15:
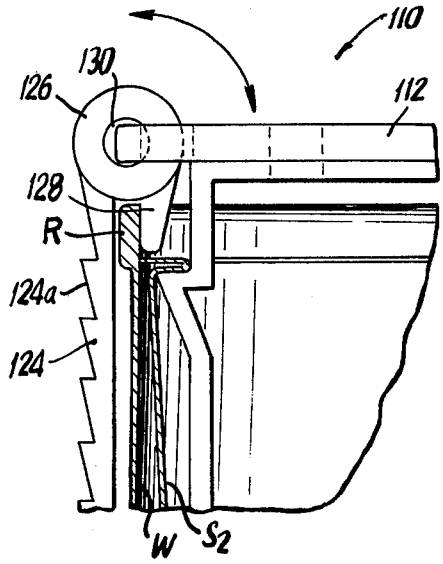
FIG. 15 is a fragmentary view and illustrates a further alternative can opener embodiment.
Figure 17:
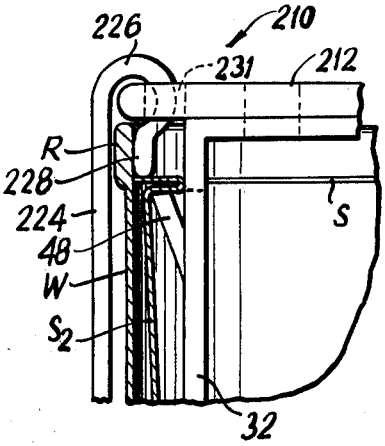
FIG. 17 is a fragmentary view and illustrates a further alternative.
Figure 19:
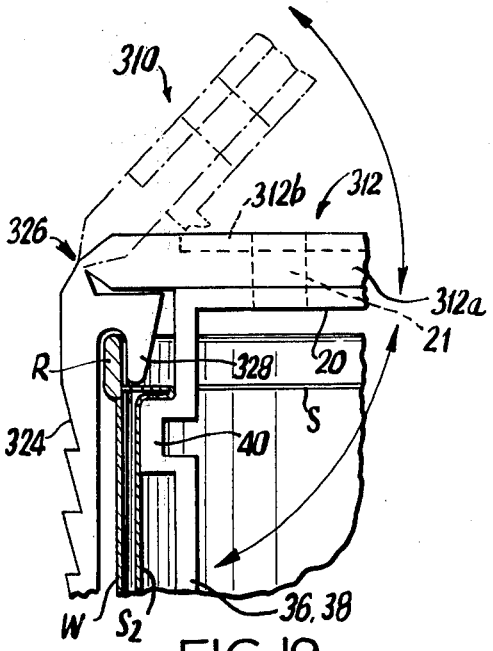

As shown in FIGS. 15, 17, and 19, this action results in the folding in "gooseneck" fashion of the upper portion of the perforated tongue $S_2$ to a depth of about three millimeters and parallel to the underside of the lid S of the can, thereby allowing the sealing lips of the capping device to situate themselves over and about the flat overlaid lid surfaces of the can. This enables the device to develop therewith an omnidirectional air-tight and leak-proof arrangement.

B. HANDLE-SUPPORT ALTERNATIVES

Figure 14:
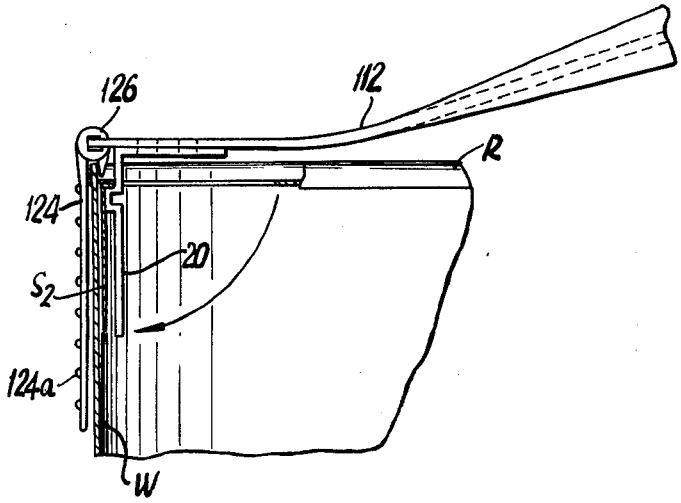
FIG. 14 is a fragmentary view and illustrates an alternative can opener embodiment in the post-opening position.

One alternative is opener 110 shown in FIGS. 14 and 15, which includes a straight side hand support 124 that may be either injection molded of reinforced plastic or metal cast with gripping ridges 124a. Support 124 includes at its upper section a housing 126 incorporating a sleeve 130 in which the end of the lever arm 112 is pivotally attached. Housing 126 also includes an integral depending anchoring bridge 128 to provide stability for the opener.

Another alternative can opener design 210 is shown in FIG. 17 and includes a straight side grip 224 which can be made of either reinforced plastic or metal. The upper end of grip 224 is shaped to form both a pivotal sleeve 226 and an anchoring bridge 228 in one continuous length. The lever arm 212 incorporates a lateral cutout 231 at its pivotal end through which bridge 228 and sleeve 226 may pass, thereby permitting the lever arm to rotate around the sleeve member 226.

Figure 18:
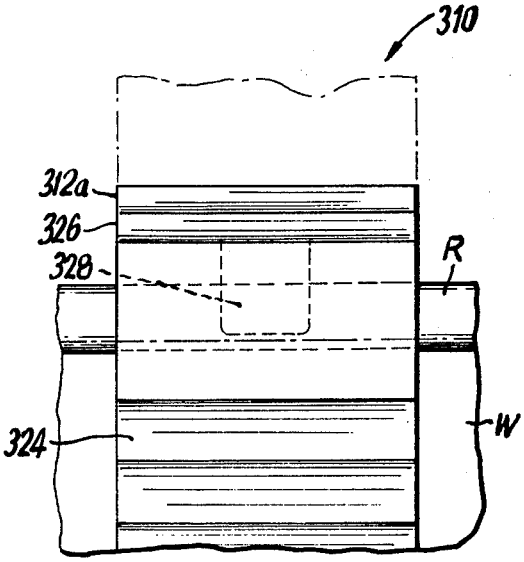
FIGS. 18 and 19 are rear and side fragmentary views, respectively, and illustrate a further can opener embodiment with a living hinge.

The lever arm and manual support may also be integral. In FIGS. 18 and 19, the opener 310 includes a lever arm 312 formed of a composite structure of a reinforced plastic frame 312a strenghtened with a metal strip 312b imbedded therein. The proximal end of frame 312a is integrally attached to a side grip 324 via a "living hinge" 326 acting as a pivot base. By injection molding process, side grip 324, anchoring bridge 328, "living hinge" 326 and frame handle 312a can be economically formed into an integral plastic unit to which the steel blade 20 and the steel cutting element 36 or 38 can be secured by means of rivets 21.

Figure 20:
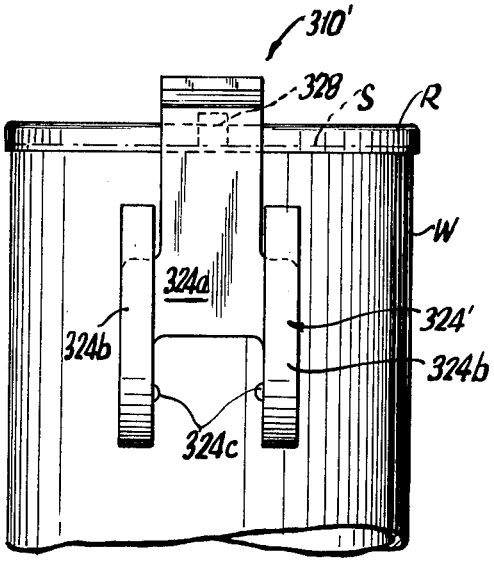
FIG. 20 is a rear view of a can opener embodiment with a living hinge and knuckle support.
Figure 21:
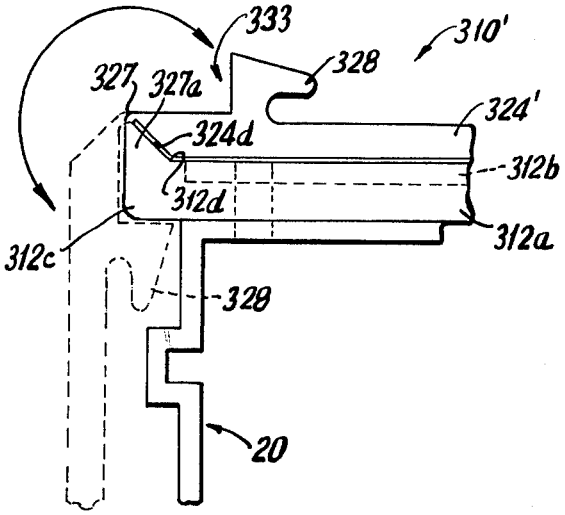
FIG. 21 is an enlarged, fragmentary view of the opener of FIG. 20 showing the nesting of the knuckle support.

A preferred version of the plastic construction can opener 310' is shown in FIGS. 20 through 23. Advantageously, opener 310' includes a hand grip 324' having a U-shaped knuckle support capable of folding over lever arm 312 in order to save storage space. The folding arrangement is made possible by two design elements: a forked hand grip 324' shown in FIG. 20, and a "living hinge" 327 allowing a 270° rotation as shown in FIG. 21.

Figure 22:
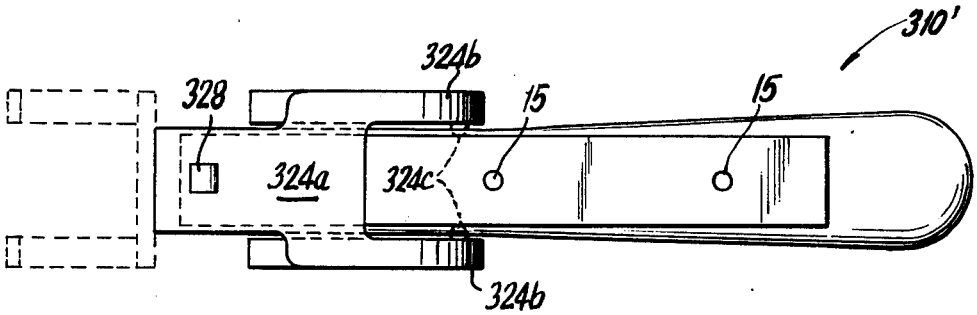
FIGS. 22 and 23 are top and side views of opener of FIG. 20.

Referring to FIGS. 20 and 22, hand grip 324' comprises in its upper section a flat element **324*a* separating toward its base into two narrower branches 324*b*** forming a generally U-shaped receptacle wide enough to allow the side of a hand to be inserted therebetween and to grasp the side of the can.

Grip 324' also incorporates toward its base two pressure points in the form of small protrusions **324*c* located on the inner edge of each branch 324*b* and designed to snap over the bottom surface of the lever arm 312. Protrusions 324*c* permit the lever arm 312 to stay locked thereon when reversed into storage position, FIGS. 22 and 23. Although not shown, the protrusions 324*c* could alternatively lock into lateral cavities situated on both sides of lever arm 312**.

Figure 23:
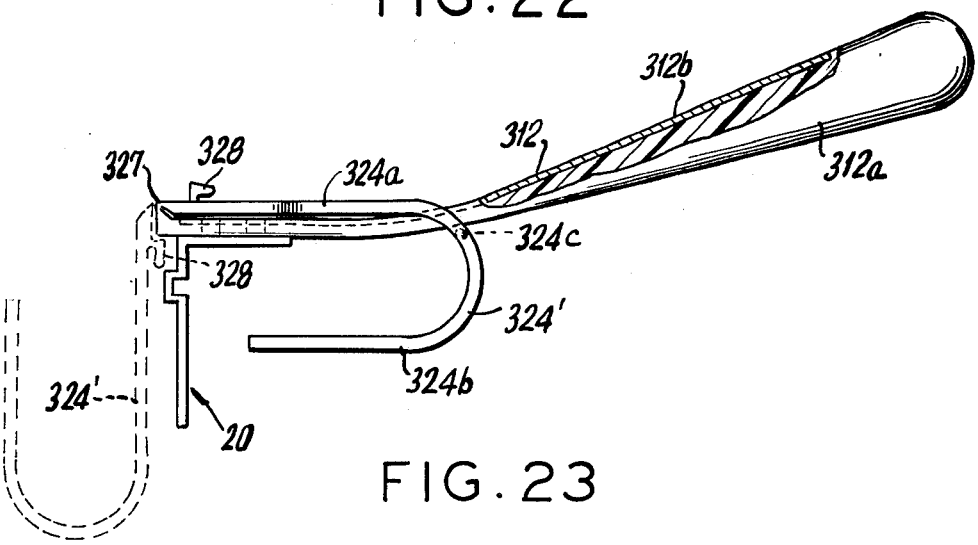

To permit the side grip 324' to flip over parallel to the upper surface of the lever arm 312, as shown in FIG. 23, provisions are made for a "living hinge" 327 situated along the apex of a raised triangular shaped tip **327*a* integrated to the upper proximal edge of the frame 312*a*, FIG. 21. In addition, the proximal end section of frame 312*a* is also configurated to match the front and back mating portions of grip 324' to permit close abutment of grip 324' to lever 312** in the folded position.

As a result, the rectangular recess 333, FIG. 21, formed between the anchoring bridge 328 and the side grip 324' can conveniently fit below the lower rectangular edge **312*c* of the frame 312*a* while the tapered upper edge 324*d* of the side grip 324' can fold over into the mating tapered upper surface 312*d* of the frame 312. Such arrangement, detailed in FIG. 21, provides the side grip 324' with a full 270° rotation to permit it to assume its storage position while also permitting the lever arm 312 to rotate 180° to effect perforation of the can top when the grip support 324'** is in vertical position and mounted on the can rim.

As mentioned earlier, injection molding can permit to produce the hand grip support and the handle element of the opener in one economical unitary construction. To that end, reinforced plastic polymers and copolymers such as glass reinforced thermoplastic polyester or nylon combining high flexural modulus, long flex life and good moldability are particularly suitable materials.

These and other modifications may be made to this invention by those skilled in the art without departing from the scope and spirit of this invention as pointed out in the appended claims.

We claim:

1. A can opener for producing an aperture having a sealable edge in a can top comprising:

integral, plastic lever arm means and manually grippable means, said manually grippable means having a generally U-shaped configuration to provide knuckle support and adapted to be positioned adjacent the wall of said can; a living hinge at the upper end of one leg of said U-shaped configuration for pivotally connecting said lever arm means thereto to provide a fulcrum; the other leg of said U-shaped configuration being bifurcated to define a lever arm receiving zone, said living hinge being operative to permit said U-shaped gripping means to be rotated into overlying relationship with said lever arm means; bridging means extending downwardly from the fulcrum to define a cavity for receiving the rim of the can; and a cutting element including a generally triangular shaped cutting blade depending from said lever arm adjacent the fulcrum, the edges of said blade being adapted and arranged to perforate the can top in the form of a generally triangular shaped flap folded downwardly into the can, said flap being attached to the can top adjacent the rim, and said blade including wedging means for folding a predetermined portion of said flap adjacent the aperture in abutting relationship with the underside of said can top, whereby a sealable edge aperture is produced in said can.

2. The can opener of claim 1, wherein the inner edges of said bifurcated leg include locking protrusions for engaging the lever arm means in the folded position.

3. The can opener of claim 1, wherein said predetermined portion is about three millimeters.

4. The can opener of claim 1, wherein said wedging means is generally rectangular in shape.

5. The can opener of claim 1, wherein said wedging means is generally triangular in shape.

6. The can opener of claim 1, wherein said cutting element is generally L-shaped, one leg being attached to said lever arm and the other leg defining said cutting blade.

7. A can opener for producing an aperture having a sealable edge in a can top comprising:

a plastic body including a lever arm at one end and a manually grippable member having a generally U-shaped configuration to define a knuckle support at the other end, and an intermediate living hinge pivotally connecting said lever arm and the end of one leg of the grippable member to form a fulcrum therefor, said grippable member including a bridging element on one side thereof adjacent said fulcrum and defining a cavity for receiving the rim of said can; said lever arm including a metal support member extending longitudinally from the fulcrum; a generally L-shaped cutting element having one leg attached to said lever arm and the other leg depending therefrom adjacent said fulcrum and on said one side of the body, said depending leg defining a generally triangular shaped cutting blade adapted to perforate the can top in the form of a generally triangular shaped flap, said flap being attached to the can top adjacent the rim, said blade further defining wedging means for folding a predetermined portion of said flap adjacent the aperture in abutting relationship with the underside of said can top, whereby a sealable edge aperture is produced in said can.

8. The can opener of claim 7, wherein the other leg of said U-shaped configuration is bifurcated to define a lever arm receiving zone, said hinge being operative to permit said U-shaped gripping means to be rotated into overlying relationship with said lever arm means, whereby the can opener may be folded for storage.

9. The can opener of claim 8, wherein the inner edges of said bifurcated leg include locking protrusions for engaging the lever arm means in the folded position.

* * * * *